US009782690B2

(12) United States Patent
Boychuk et al.

(10) Patent No.: US 9,782,690 B2
(45) Date of Patent: Oct. 10, 2017

(54) ARBOR TRAP APPARATUS FOR COUNTERWEIGHT RIGGING SYSTEM

(71) Applicant: Grid Well Inc., Picton (CA)

(72) Inventors: Richard William Boychuk, Picton (CA); Richard Joseph Nix, Park Hills, KY (US)

(73) Assignee: GRID WELL INC., Picton (CA)

( * ) Notice: Subject to any disclaimer, the term of this patent is extended or adjusted under 35 U.S.C. 154(b) by 0 days.

(21) Appl. No.: 15/287,916

(22) Filed: Oct. 7, 2016

(65) Prior Publication Data

US 2017/0100680 A1 Apr. 13, 2017

Related U.S. Application Data

(60) Provisional application No. 62/238,241, filed on Oct. 7, 2015.

(51) Int. Cl.

| | |
|---|---|
| ***A63J 1/02*** | (2006.01) |
| ***B66D 1/26*** | (2006.01) |
| ***B66D 1/60*** | (2006.01) |
| *B66D 1/36* | (2006.01) |

(52) U.S. Cl.

CPC ..... *A63J 1/028* (2013.01); *B66D 1/26* (2013.01); *B66D 1/60* (2013.01)

(58) Field of Classification Search

CPC ..... A63J 1/028; A63J 5/00; A63J 5/02; A63J 5/12; A63G 31/00; A63G 31/10; B66D 1/00; B66D 1/36; B66D 1/39; B66B 5/00; B66B 5/12; B66B 5/1217

USPC ..... 472/2, 75–80; 187/266, 366, 404

See application file for complete search history.

(56) References Cited

U.S. PATENT DOCUMENTS

| | | | |
|---|---|---|---|
| 537,558 | A | 4/1895 | Arthur |
| 1,261,775 | A | 4/1918 | Curran et al. |
| 1,944,603 | A | 1/1933 | Hecker |
| 2,991,526 | A | 7/1961 | Kuebler |
| 3,101,130 | A | 8/1963 | Bianca |
| 3,165,296 | A | 1/1965 | Drew |

(Continued)

FOREIGN PATENT DOCUMENTS

| | | | |
|---|---|---|---|
| EP | 1595840 | A1 | 11/2005 |
| JP | 2002173281 | A | 6/2002 |

OTHER PUBLICATIONS

TSE (Thern Stage Equipment), Brickhouse Front-Loading Counterweight Arbor System, Winona, Minnesota, USA.

(Continued)

*Primary Examiner* — Kien Nguyen
(74) *Attorney, Agent, or Firm* — Bereskin & Parr LLP/S.E.N.C.R.L., s.r.l.

(57) ABSTRACT

An arbor trap apparatus for use with a counterweight rigging system having at least one counterweight arbor. The apparatus may include a trap housing for attachment to a support structure, and at least one catch blade for attachment to the counterweight arbor. The catch blade may enter the trap housing as the counterweight arbor moves generally towards the trap housing, and the trap housing may engage the catch blade to prevent the counterweight arbor from moving generally away from the trap housing. The trap housing may transfer load from the counterweight arbor to the support structure and prevent a runaway.

20 Claims, 6 Drawing Sheets

(56) References Cited

U.S. PATENT DOCUMENTS

| | | | | |
|---|---|---|---|---|
| 3,327,999 | A * | 6/1967 | Mitchell | E06B 9/324 24/134 R |
| 4,134,177 | A | 1/1979 | Janson | |
| 4,303,237 | A * | 12/1981 | Hoffend, Jr. | A63J 1/028 472/78 |
| 4,795,405 | A | 1/1989 | Davis | |
| 5,435,417 | A | 7/1995 | Hakala | |
| 5,531,297 | A | 7/1996 | Pipan | |
| 5,573,084 | A | 11/1996 | Hakala | |
| 5,711,713 | A | 1/1998 | Krueger | |
| 5,931,265 | A | 8/1999 | Hollowell et al. | |
| 5,996,970 | A | 12/1999 | Auerbach | |
| 6,138,799 | A | 10/2000 | Schroder-Brumloop et al. | |
| 6,193,018 | B1 | 2/2001 | Schroder-Brumloop et al. | |
| 6,382,361 | B2 | 5/2002 | Nihei et al. | |
| 6,537,155 | B2 | 3/2003 | Steve et al. | |
| 6,855,063 | B2 | 2/2005 | Murphy et al. | |
| 6,948,594 | B2 | 9/2005 | Hossler | |
| 7,165,295 | B2 | 1/2007 | DeWitt et al. | |
| 7,264,228 | B2 | 9/2007 | Kaiser et al. | |
| 7,275,733 | B2 | 10/2007 | Svitavsky et al. | |
| 7,963,505 | B2 | 6/2011 | Taylor et al. | |
| 2006/0163548 | A1 | 7/2006 | Kochan et al. | |
| 2007/0227830 | A1 | 10/2007 | Svitavsky et al. | |
| 2008/0116018 | A1 | 5/2008 | Wieland | |
| 2008/0190706 | A1 | 8/2008 | Franklin | |
| 2011/0042634 | A1 | 2/2011 | Boychuk | |

OTHER PUBLICATIONS

Hall Stage Limited, The DGS Counterweight Drive System, Luton, UK.

J.R. Clancy, Inc., Rigging System Design Guide, 2009, Syracuse, New York, USA.

J.R. Clancy, Inc., SureStop Head Block, Syracuse, New York, USA.

J.R. Clancy, Inc., PowerAssist®, Syracuse, New York, USA.

TSE (Thern Stage Equipment), Reliable Rigging Systems, Winona, Minnesota, USA.

Jacob Coakley, "Asking questions, developing solutions", www.stage-directions.com, Jul. 2013, Timeless communications, Las Vegas, Nevada, USA.

* cited by examiner

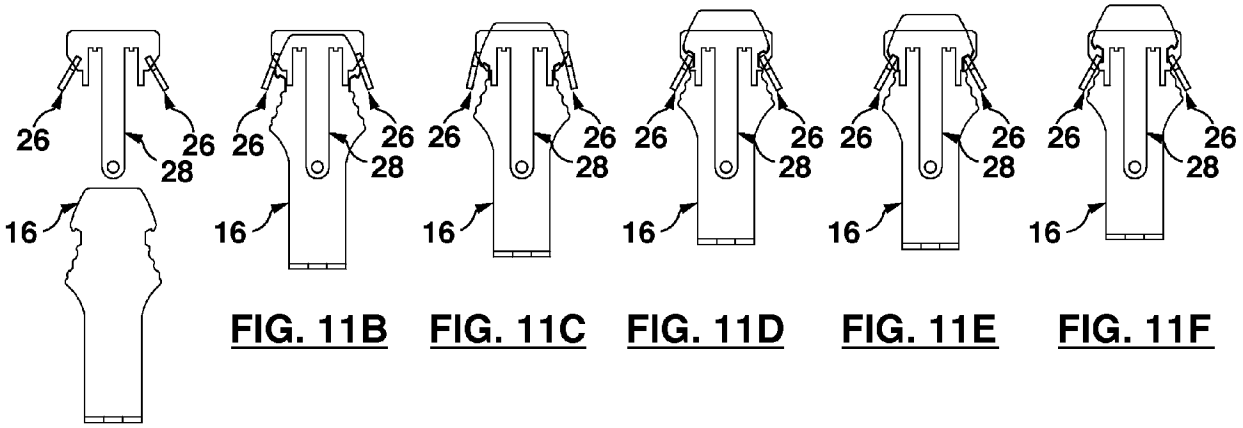
FIG. 11A
FIG. 11B
FIG. 11C
FIG. 11D
FIG. 11E
FIG. 11F
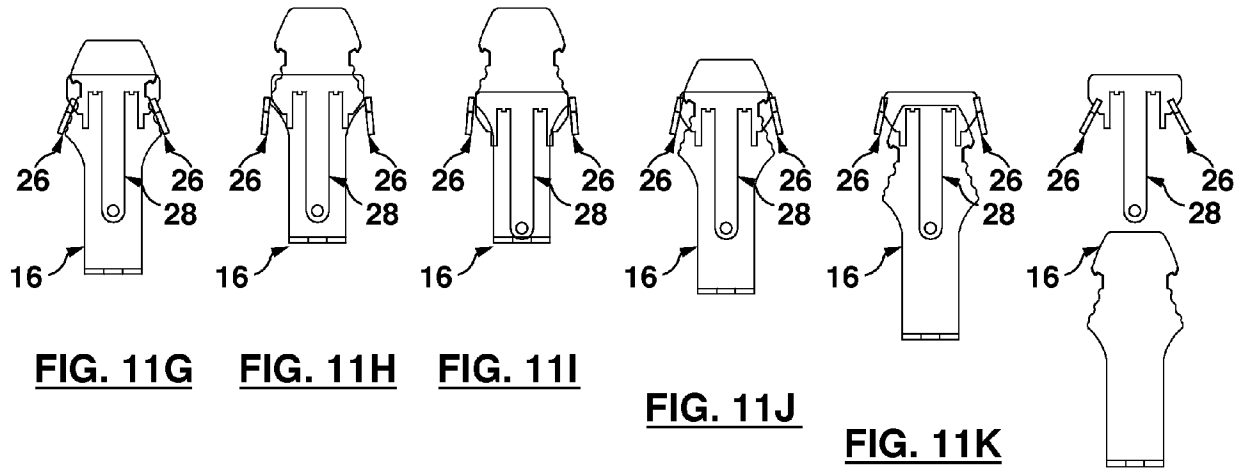
FIG. 11G
FIG. 11H
FIG. 11I
FIG. 11J
FIG. 11K
FIG. 11L

ARBOR TRAP APPARATUS FOR COUNTERWEIGHT RIGGING SYSTEM

CROSS-REFERENCE TO RELATED APPLICATION

This application claims priority to U.S. Provisional Application No. 62/238,241 filed on Oct. 7, 2015, the entire contents of which are hereby incorporated herein by reference.

FIELD

The present disclosure relates to theatrical rigging systems and related hardware.

INTRODUCTION

The following paragraphs are not an admission that anything discussed in them is prior art or part of the knowledge of persons skilled in the art.

The uncontrolled descent of a counterweight arbor is commonly called a runaway. Runaway arbors have occurred since the first days of counterweighted systems in theatres. In the normal use of a line set, counterweights are added to the arbor on one end of the line set to equal the weight of a load (such as a piece of scenery) on the other end of the line set. When the counterweight and the load are in balance with each other, all is fine.

There are, however, a number of circumstances in which the counterweight and the load can become out of balance. Most of these circumstances occur during the loading and unloading of the counterweight arbor and can be attributed to one or more of the following: lack of understanding of how the system works; lack of procedures; lack of training; lack of communication; and/or operator fatigue. The vast majority of runaways start with the arbor at the top of its travel.

An empty standard arbor generally weighs no more than 100 pounds. By design, arbors have capacity for receiving 1,500 to 2,000 pounds of counterweight, and it is not uncommon for an arbor to have a capacity of 3,000 pounds. Counterweights may be added to and removed from the arbor on a daily basis as productions go in to and out of a theatre. The threat of an unbalanced line set lies in the requirement of changing the counterweight and load. If the line set is loaded or unloaded improperly, and the line set becomes unbalanced a runaway can occur. A runaway can result in severe damage to the system, injury to workers or, in rare circumstances, death. Almost every instance of a runaway involves the heavy runaway arbor beginning from the very top of its range of travel and engaging in an uncontrolled descent to the bottom of its travel.

Until now, the most common method of mitigating the risk of runaway arbors has been the adoption of procedures for properly loading and off-loading arbors. But proper procedure is not always followed. As human capacity for mistakes is persistent, procedures alone have not proven sufficient to completely eliminate the risk of a runaway.

Another method of risk mitigation might be with the introduction of a mechanical device. Devices used for runaway mitigation include out-of-balance detecting rope locks, an over-speed locking head block and a guide rail brake.

Out-of-balance detecting rope locks, including automatic mechanisms, detect an imbalance and disallow the rope lock from opening, thus preventing a runaway. The out-of-balance detecting rope lock is a passive safety device; the operator does not need to take any specific action to invoke it. However, this method transfers the load of the overloaded arbor from the load path of the counterweight system to the operating path. In doing so, this approach does not conform to the recently implemented ANSI E1.4 Standards for Counterweight Systems, which specifies that the operating path of a counterweight system must not be loaded beyond 50 pounds (22 kilograms). Examples of out-of-balance detecting rope locks are disclosed in U.S. Pat. Nos. 1,994,603, 2,991,526, 5,531,297, 6,948,594 B2 and 7,165,295 B2.

The over-speed locking head block is a passive safety device; the operator does not need to take any specific action to invoke it. If the lineset goes out of balance and a runaway ensues, the headblock mechanism detects the overspeed situation and stops the runaway. However, the process of stopping a laden arbor once the runaway has commenced can impose a shock load on the line set. Shock loading a line set—especially were it to occur a number of times—can be detrimental to its integrity. An example of an over-speed locking head block is marketed as the SureStop™ head block (J R Clancy, Syracuse, N.Y.).

The guide rail brake has brake shoes that engage with the guide rail. The brake shoes are intended to engage with the rail and thus stop the runaway. The guide rail brake is an active safety device; the operator needs to pull an activation cord to engage it. When an arbor starts to runaway this method requires a certain presence of mind; that presence of mind is seldom available under the dangerous situation of a runaway arbor. Furthermore, the guide wall, which would be required to support the guide rail brake, is not intended to bear any weight, let alone that of a laden arbor. Thus, it is possible that the guide rail brake would not conform with ANSI E1.4. An example of a guide rail brake device is disclosed in U.S. Publication No. 2007/0227830 A1.

SUMMARY

The following paragraphs are intended to introduce the reader to the detailed description that follows and not to define or limit the claimed subject matter.

In summary, a need exists for a device that will prevent runaways that meets the following criteria: it conforms to ANSI E1.4; it can be easily accessed and operated by general personnel; it does not need adjustment after deployment; and/or it does not impose a shock load on the line set.

The present disclosure relates to an arbor trap apparatus. The arbor trap apparatus is a safety device for use in conjunction with a counterweight rigging system on a theatre stage or similar building. In some examples, in the case of an imbalance in the line set, the arbor trap apparatus can trap the offending arbor at the uppermost point of its range of travel, thus avoiding uncontrolled descent of a counterweight arbor.

The arbor trap apparatus may be a passive safety device designed to prevent runaways, may conform to ANSI E1.4 and may be easily accessed and operated by general personnel. After deployment, the arbor trap apparatus may require no maintenance.

The arbor trap apparatus is intended to prevent a potential runaway arbor in a counterweight line set without putting stress on the operating path or the load path of line set. The arbor trap apparatus is further intended to be able to repeatedly prevent runaways without the need for special service, adjustment or maintenance. The arbor trap apparatus may be assembled in situ into existing line sets of existing counterweight systems. The arbor trap apparatus may be integrated into a head block at the top or into a tension block at the bottom of the counterweight rigging system. Alternatively, the arbor trap apparatus may be integrated into the counterweight arbor.

The arbor trap apparatus can include a trap housing, generally attached to the structure of the building, and catch blades that are generally attached to the counterweight arbor. As the counterweight arbor ascends, the catch blades can enter the apparatus and are prevented from descending until released. If the line set is out of balance at the attempted release, the catch blades will not be released and the counterweight arbor cannot descend.

In some examples, when the counterweight arbor reaches the top of its travel, the catch blade at its top can open flaps of the apparatus. The catch blades may have a profile that opens the flaps; the profile is further configured to allow the flaps to close into a catch position.

If the counterweight arbor is overloaded, or if the batten is underloaded, the counterweight arbor will descend slightly. This is allowed by the stretch of the operating line of the line set. As the operating line stretches ever so slightly, the catch blades descend upon the flaps and the counterweight arbor is prevented from descending further. With enough extra weight upon the counterweight arbor, the flaps are caught by barbs of the catch blade and will be secured. Only by increasing the weight on the batten or reducing the weight on the counterweight arbor can the catch blades be lifted off the flaps and thereby be released.

The release of the catch blades can be facilitated by the flaps being held in their widest open position by the profile of the catch blades. While the counterweight arbor of the balanced line set is at its uppermost point of travel, the flaps are at their open position. When the flaps are at their open position, a release blade can be lowered into a release position and will hold the flaps open so that the counterweight arbor can descend.

If the counterweight arbor is heavier than the batten, the catch blades can descend a fraction of an inch, and the flaps will close enough that the release blade will not be able to be pulled into the release position between the flaps, therefore the counterweight arbor will not be able to be freed from the apparatus.

When the arbor trap apparatus is engaged, i.e. 'trapping' the counterweight arbor, the counterweights in the arbor must be unloaded until balance is achieved. When balance is achieved, the flaps will open as a result of the unloaded counterweight arbor ascending slightly and the profile of the catch blades holding the flaps at their open position. It is at this moment that the release mechanism may be activated.

In some examples, the arbor trap apparatus may be located at the top of the counterweight arbor's path of travel, and thereby above the counterweight arbor. In these examples, the arbor trap apparatus traps the counterweight arbor when the counterweight arbor tries to exit the trap housing by moving generally away from the trap housing in a downward direction. In some other examples, the arbor trap apparatus may be located at the bottom of the counterweight arbor's path of travel and, thereby below the counterweight arbor. In these examples, the arbor trap apparatus traps the counterweight arbor when the counterweight arbor tries to enter the trap housing by moving generally towards the trap housing in a downward direction.

In some examples, the arbor trap apparatus may be a single unit while in some other examples the arbor trap apparatus may comprise a plurality of arbor trap apparatuses enclosed in a longer trap housing, extending longitudinally along the travel paths of multiple arbors.

In some examples, the trap housing may be attached to the counterweight arbor and the catch blades may be attached to the structure of the building. In these examples, it is the trap housing that can move towards or away from the catch blades as the catch blades can be stationary.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings:

FIGS. 11A to 11L show a sequence of views of components of the arbor trap apparatus.

DETAILED DESCRIPTION

Figure 1:
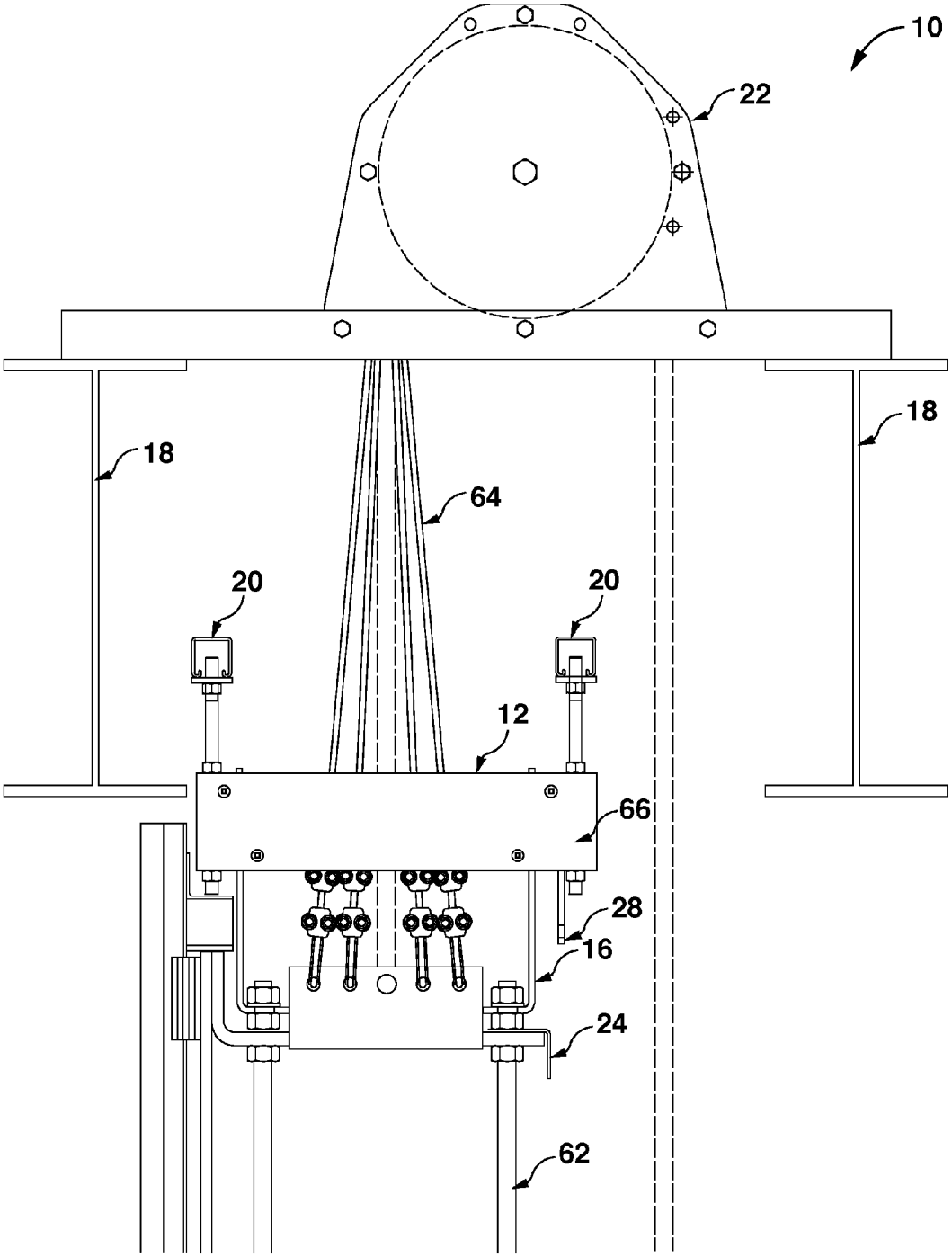
FIG. 1 shows an example of an arbor trap apparatus in relation to other components of a counterweight rigging system.
Figure 2:
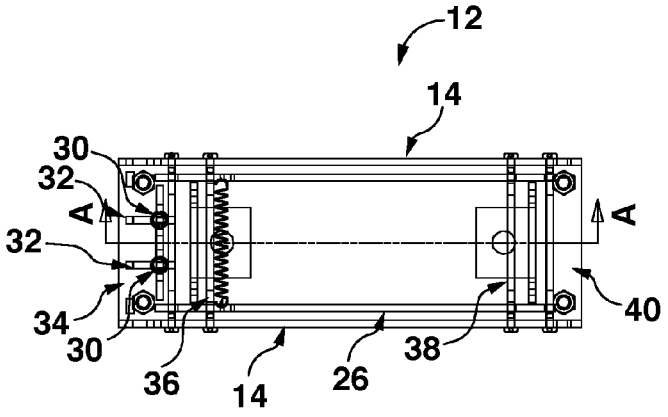
FIG. 2 shows a top view of the arbor trap apparatus.
Figure 3:
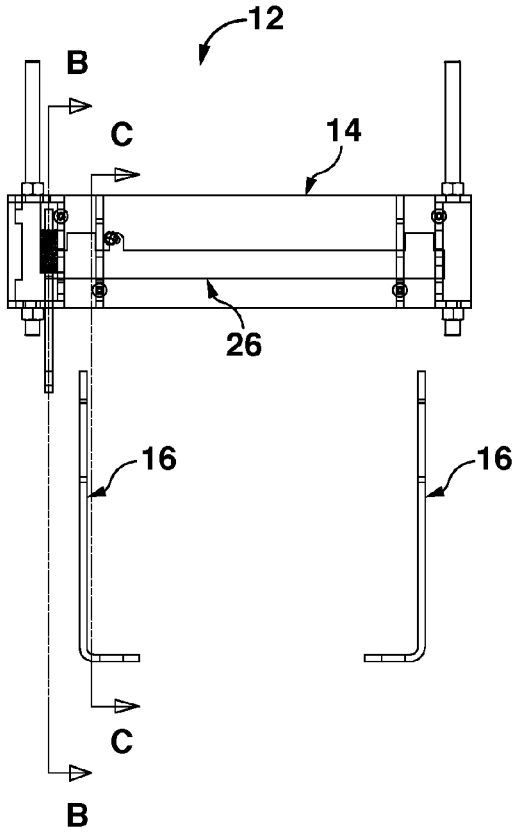
FIG. 3 shows a side view of the arbor trap apparatus illustrating catch blades for attachment to an arbor of the counterweight rigging system.

Various apparatuses and/or methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Referring to FIGS. 1 to 10, an arbor trap apparatus is illustrated generally at reference numeral 12. The arbor trap apparatus 12 includes a trap housing 66 that appears as a simple box made of a strong material, usually steel. The arbor trap apparatus 12 may hold the full load of a counterweight arbor 24 of a counterweight rigging system 10, which may be unbalanced.

In some examples, the excess load of an imbalanced counterweight arbor 24 may be borne by the arbor trap apparatus 12 and transferred to the structure of the building, e.g., to head beams 18, either by being affixed to them directly or by being affixed to a sub-frame 20, which is in turn attached to the structure of the building. The sub-frame 20 can be of various constructions.

In the example illustrated, the arbor trap apparatus 12 is located at the top of a path of travel of the counterweight arbor 24, or above the counterweight arbor 24. In these examples, the counterweight arbor 24 enters the trap housing 66 while it is ascending to its uppermost point of travel, i.e. towards the trap housing 66. In other examples (not shown), the arbor trap apparatus 12 may be located at the bottom of the path of travel of the counterweight arbor 24, or below the counterweight arbor 24. In these examples, the counterweight arbor 24 moves away from the trap housing 66 as the counterweight arbor 24 ascends to its uppermost point of travel.

The arbor trap apparatus 12, in other examples (not shown), may be affixed to head blocks 22, incorporated into the design of the head blocks 22, and/or incorporated into the design of the counterweight arbor 24. In some examples (not shown), the arbor trap apparatus 12 may be incorporated into the design of or affixed to tension blocks (not shown) located at the bottom of the counterweight rigging system 10.

In the example illustrated, a pair of catch blades 16 is attached to the counterweight arbor 24. Two flaps 26, internal to the apparatus 12, may swing outwardly and upwardly when pressure is applied from below by the ascending counterweight arbor 24. The catch blades 16, which may be mounted directly to a top of the counterweight arbor 24, may have a profile, described below, that gets trapped on the flaps 26 so that the counterweight arbor 24 may pass through the apparatus 12 while moving in an upward direction, but not while moving in a downward direction.

The profile of the catch blades 16 may be important to the proper functioning of the arbor trap apparatus 12. In the example illustrated, referring to FIG. 4, each of the catch blades 16 may be generally symmetrical and include an elongate body portion 50 for attachment to the counterweight arbor, a flared portion 52, and a catch portion 54 having an angled flange 56 with downwardly facing barbs 58. The flared portion 52 extends between the body portion 50 and the catch portion 54. The flared portion 52 increases in width moving downwardly along the length of the catch blade 16 towards the body portion 50. The width of the flared portion 52 at its widest point is greater than a width of the catch portion 54 at its widest point.

Figure 5:
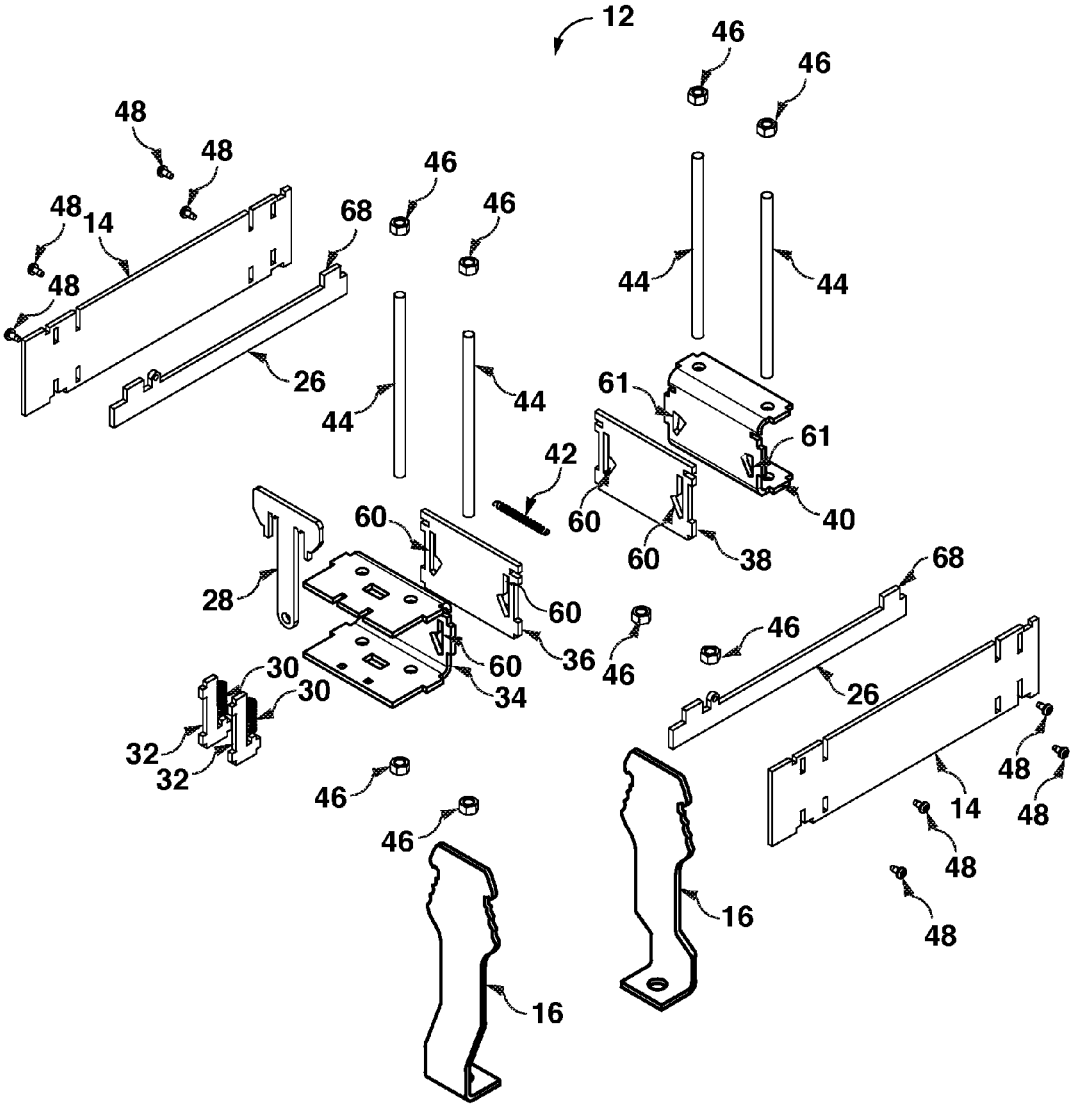
FIG. 5 shows an exploded view of the arbor trap apparatus.
Figure 6:
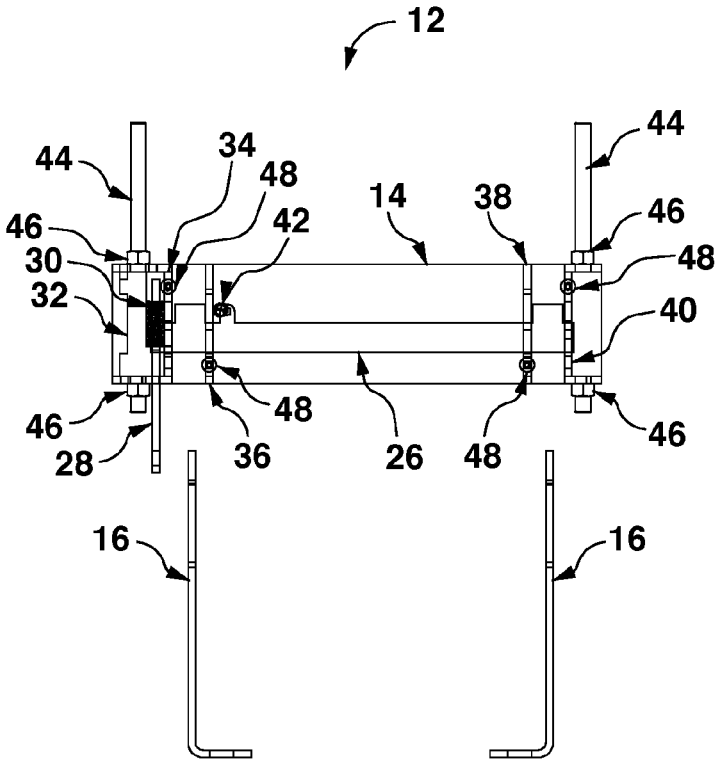
FIG. 6 shows a sectional view of the arbor trap apparatus along line A-A of FIG. 2.
Figure 7:
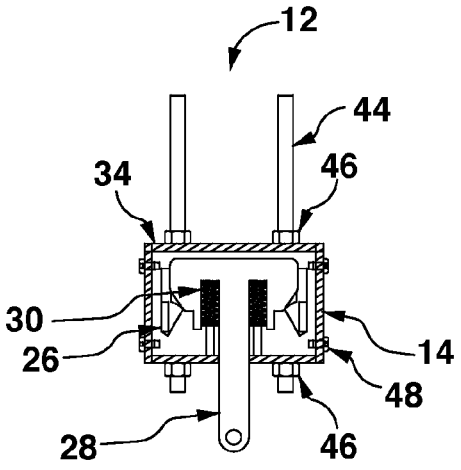
FIG. 7 shows a sectional view of the arbor trap apparatus along line B-B of FIG. 3.
Figure 8:
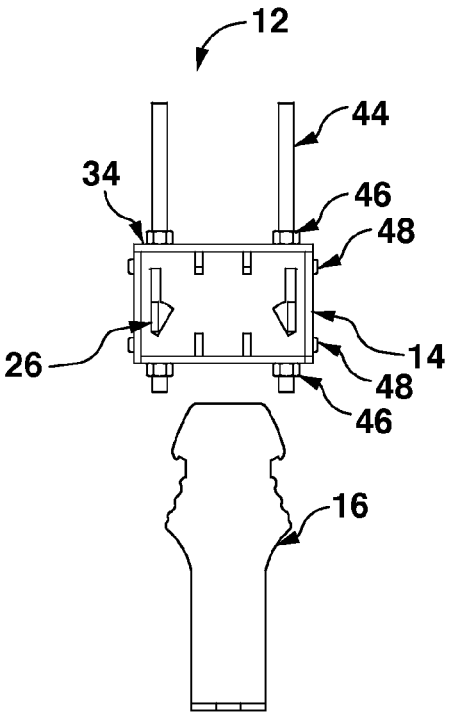
FIG. 8 shows a sectional view of the arbor trap apparatus along line C-C of FIG. 3.
Figure 9:
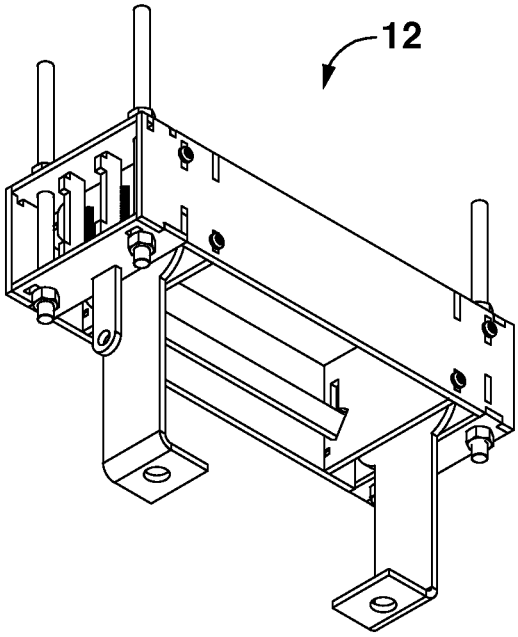
FIG. 9 shows a lower, front perspective view of the arbor trap apparatus.
Figure 10:
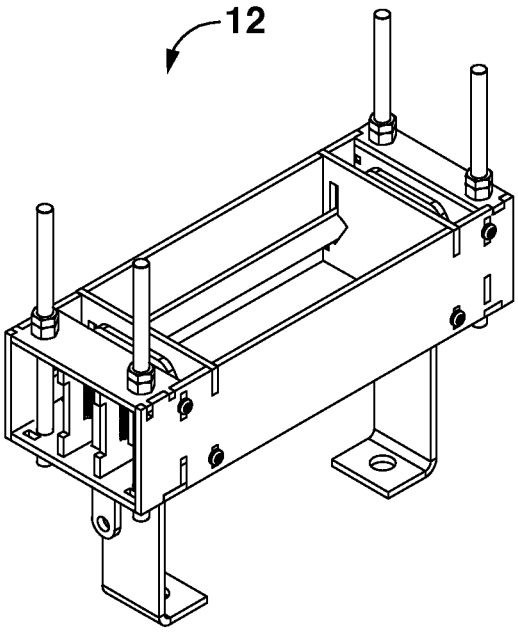
FIG. 10 shows an upper, front perspective view of the arbor trap apparatus.

The profile of the flaps 26 is best shown in FIGS. 5 and 6. In the example illustrated, each of the flaps 26 takes the form of an elongate beam having two upwardly facing teeth 68, each located at a spaced apart position relative to ends of the flap 26.

The flared portion 52 is shown to include serrated edge features. The serrated edge features can facilitate release of the catch blades 16 from the trap housing 66. In some examples, the serrated edge features can create two symmetrical curvilinear series of contact points designed to maintain contact with the teeth 68 nearest to their tops to exert the majority of forces on each tooth 68 outwardly rather than upwardly to open the flaps 26.

In the example illustrated, the arbor trap apparatus 12 includes a release blade 28. If the counterweight arbor 24 is lowered either by an operator or from an imbalance of the load without the release blade 28 being engaged, the barbs 58 will engage and trap the teeth 68 of the flaps 26, and thereby the counterweight arbor 24 cannot descend. The flaps 26 may not be disengaged if the weight of the counterweight arbor 24 is resting upon them, and thus the counterweight rigging system 10 must be correctly and safely balanced in order for the counterweight arbor 24 to be released.

In the example illustrated, with a properly balanced line set 64, for the counterweight arbor 24 to pass downwardly through the arbor trap apparatus 12, the release blade 28 must be pulled down. When the release blade 28 is pulled down, it can be moved into a release position that serves to maintain the flaps 26 separated away from one another. This in turn allows the catch blades 16 to pass downwardly through the arbor trap apparatus 12.

In the example illustrated, the release blade 28 rests upon compression springs 30, which in turn rest upon spring plates 32. The compression springs 30 can keep the release blade 28 out of engagement unless the release blade 28 is pulled down. The release blade 28 may have a handle, e.g., a cord of some description (not shown) tied to the release blade 28, having sufficient length that the operator can safely reach and pull it. The spring plates 32 may be secured to the front load channel 34.

In the example illustrated, the arbor trap apparatus 12 includes vertical load members in the form of a front load channel 34, first and second interior load plates 36, 38, and a rear load channel 40. The flaps 26 are inserted through keyhole slots 60 in each of the load channel 34 and the load plates 36, 38. During assembly, keyhole slots 61 in the load channel 40 receive the flaps 26 after insertion through the keyhole slots 60. As illustrated in FIG. 5, there is a narrow section extending vertically upwards from each of the keyhole slots 60. The narrow sections allow the teeth 68 of the flaps 26 to pass through the load channel 34 and the load plates 36, 38 during assembly of the arbor trap apparatus 12. The keyhole slots 61 in the load channel 40 do not have a corresponding narrow section, in contrast to the keyhole slots 60. Thus, the keyhole slots 61 can provide for precise positioning of the flaps 26 within the arbor trap apparatus 12 during assembly and can prevent the flaps 26 from sliding out of the arbor trap apparatus 12 in operation.

In the example illustrated, the load channels 34, 40 and the load plates 36, 38 are shown attached to side plates 14, each of which may be held in place with screws 48 or other fastening device. The described assembly forms the trap housing 66.

In the example illustrated, the load channels 34, 40 support the arbor trap apparatus 12 with threaded rods 44 and locking nuts 46, which secure the threaded rods 44 to the load channels 34, 40 from below and above. The threaded rods 44 may be bolted directly to a structure of the building, such as the head beams 18, or to a sub-structure attached to the building, such as the sub-frame 20, thereby transferring the load from the load channels 34, 40 to the building structure.

Although the flaps 26 can be chiefly activated by the catch blades 16 to open and by gravity to close, a tension spring 42 may be added to ensure that the flaps 26 remain in the catch position when not in contact with the catch blades 16.

Figure 4:
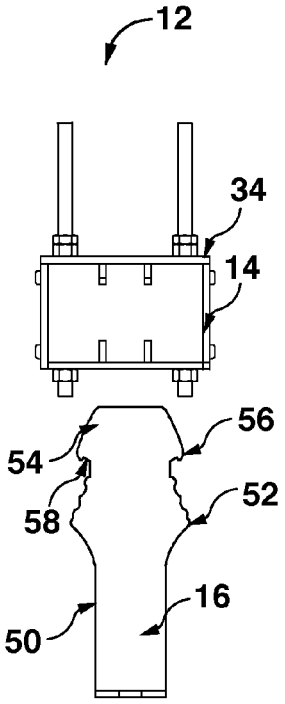
FIG. 4 shows an end view of the arbor trap apparatus.

Referring now to FIGS. 11A to 11L, and with continued reference to FIGS. 1, 4 and 5, operation of the catch blade 16, the flaps 26 and the release blade 28 of the arbor trap apparatus 12 is illustrated.

Initially, as shown in FIG. 11A, the counterweight arbor 24 is located between the arbor trap apparatus 12 and its lowermost point of travel. The catch blades 16 are spaced apart from the trap housing 66 and the flaps 26 are in the catch or closed position.

In FIG. 11B, the counterweight arbor 24 has ascended and the catch blades 16 have entered the trap housing 66. In this pre-engagement phase, the angled flange 56 of the catch portion 54 is positioned to push the flaps 26 outwardly away from the catch position by making contact with the teeth 68 of the flaps 26.

In FIG. 11C, the counterweight arbor 24 has ascended further and the angled flange 56 is pushing the flaps 26 apart to a first, partially opened position.

As the counterweight arbor 24 ascends further, as shown in FIG. 11D, the angled flange 56 has cleared through the flaps 26 and gravity and/or the tension spring 42 pulls the flaps 26 together again to return to the catch position.

In FIG. 11E, the counterweight arbor 24 has descended and the barbs 58 of the catch blades 16 engage the teeth 68 of the flaps 26. In this engagement phase, the counterweight arbor 24 is prevented from descending further. Thus, the line set 64 is prevented from becoming a runaway. To release the counterweight arbor 24, the counterweight arbor 24 must again be raised and the release blade 28 activated, as described below.

FIGS. 11F and 11G show the counterweight arbor 24 being raised and the flared portion 52 bears against the flaps 26 and serves to move them away from one another.

In the sequence illustrated in FIGS. 11A to 11G, it is not possible to move the release blade 28 into the release position because the release blade 28 is blocked by the flaps 26.

In FIG. 11H, the counterweight arbor 24 has ascended to its uppermost point of travel and the flared portion 52 contacts the teeth 68 of the flaps 26. In this pre-release phase, the widest part of the flared portion 52 is pushing the flaps 26 apart outwardly away from the catch position to a second, fully opened position. The release blade may now pass clear between the flaps 26 and therefore the operator can pull down the release blade 28 into the release position, as illustrated in FIG. 11I.

In FIGS. 11J and 11K, with the release blade 28 in the release position, the flaps 26 are maintained in the second opened position by the release blade 28, and the counterweight arbor 24 can descend without the flaps 26 engaging the barbs 58 of the catch blades 16.

Finally, in FIG. 11L, the catch blades 16 have exited the trap housing 66, and the arbor trap apparatus 12 is ready to be deployed again. In this post-release phase, the release blade 28 can move upwardly back to its initial position by help of the compression springs 30.

In the example illustrated, the catch blades 16 are each mounted onto vertical rods 62 of the counterweight arbor 24, as shown in FIG. 1. In other examples (not shown), the system may be inverted so that the catch blades 16, which are attached to the structure of the building, such as head beams 18 or sub-frame 20, point downwardly. In such examples, the trap housing 66 are attached to the counterweight arbor 24. Alternatively, in yet other examples (not shown), either the catch blades 16 or the trap housing 66 may be integrated into the design and construction of the counterweight arbor 24.

In other examples (not shown), instead of having a single arbor trap apparatus 12, a plurality of arbor trap apparatuses 12 may work in unison. In these examples, a longer trap housing (not shown) extending longitudinally along the path of travel of the counterweight arbor 24 encloses the plurality of arbor trap apparatuses 12 located along the path of the travel of the counterweight arbor 24.

Furthermore, the arbor trap apparatus 12 may be designed to be both an OEM and a retrofit device. As a retrofit product, the arbor trap apparatus 12 may be assembled during installation to surround the loft lines and the purchase line of the line set 64. The loft lines and purchase lines may be disconnected to allow installation, but doing so may result in significant work. Certain features of the design, as described below, may be required to accomplish in situ assembly, including the keyhole slots 60, 61. The pre-assembly of one side plate 14, one flap 26 and the load channels 34, 40 and the load plates 36, 38 may allow the arbor trap apparatus 12 to be installed around the loft lines and the purchase line. Once the pre-assembly has been positioned, the second side plate 14, one flap 26 can be installed and fastened, thereby eliminating the work associated with disconnection of the loft lines and purchase lines.

Although this specification describes apparatuses that have particularly useful application to the field of theatrical stage rigging, it should be appreciated that other applications of the teachings herein are possible.

While the above description provides examples of one or more apparatuses and/or methods, it will be appreciated that other apparatuses and/or methods may be within the scope of the accompanying claims.

We claim:

1. An arbor trap apparatus for use with a counterweight rigging system having at least one counterweight arbor, the apparatus comprising:

a trap housing for attachment to a support structure; and at least one catch blade comprising a body portion for attachment to the counterweight arbor, wherein the catch blade is configured to enter the trap housing as the body portion moves generally towards the trap housing, and wherein the trap housing is configured to engage the catch blade to prevent the body portion from moving generally away from the trap housing.

2. The apparatus of claim 1, comprising at least one flap mounted in the trap housing for engaging the catch blade, the flap being moveable between a catch position in which the flap is engageable with the catch blade and an opened position in which the catch blade is releasable from the trap housing.

3. The apparatus of claim 2, wherein the flap is configured to swing between the catch position and the opened position.

4. The apparatus of claim 3, wherein the flap is biased to the catch position.

5. The apparatus of claim 3, wherein the flap comprises first and second flaps positioned to engage the catch blade on generally opposing sides thereof.

6. The apparatus of claim 5, wherein the first and second flaps are biased towards one another for maintaining each in the catch position.

7. The apparatus of claim 6, comprising a tension spring arranged between the first and second flaps.

8. The apparatus of claim 3, wherein:

the catch blade comprises a catch portion, the catch portion comprising an angled flange and a barb arranged between the angled flange and the body portion;

as the body portion moves towards the trap housing, the angled flange is configured to bear against the flap and at least partially move the flap from the catch position towards the open position until the angled flange has cleared through the flap and the flap returns to the catch position; and as the body portion moves away from the trap housing, the barb is configured to engage an edge of the flap while in the catch position and prevent the body portion from moving away from the trap housing.

9. The apparatus of claim 8, wherein the catch blade comprises a flared portion extending between the body portion and the catch portion, the flared portion increasing in width moving towards the body portion, and, as the body portion moves further towards the trap housing, the flared portion is configured to bear against the flap and move the flap from the catch position to the opened position.

10. The apparatus of claim 9, wherein a width of the flared portion at its widest point is greater than a width of the catch portion at its widest point.

11. The apparatus of claim 3, comprising a release mechanism for moving the flap to the opened position.

12. The apparatus of claim 11, wherein the release mechanism comprises a release blade that is moveable between a retained position in which the flap is maintained in the catch position and a release position in which the flap is moveable to the opened position.

13. The apparatus of claim 12, wherein the flap comprises first and second flaps positioned to engage the catch blade on generally opposing sides thereof, and in the release position the release blade is positioned between the first and second flaps and maintains them separated away from one another in the opened position.

14. The apparatus of claim 12, wherein:

the catch blade comprises a body portion for attachment to the counterweight arbor, a catch portion, the catch portion comprising an angled flange and a barb arranged between the angled flange and the body portion;

as the body portion moves towards the trap housing, the angled flange is configured to bear against the flap and partially move the flap from the catch position towards the open position until the angled flange has cleared through the flap and the flap returns to the catch position;

as the body portion moves away from the trap housing, the barb is configured to engage an edge of the flap while in the catch position and prevent the body portion from moving away from the trap housing; and with the flap either in the catch position or partially moved towards the opened position, the flap blocks the release blade from moving to the release position.

15. The apparatus of claim 14, wherein the catch blade comprises a flared portion extending between the body portion and the catch portion, the flared portion increasing in width moving towards the body portion, as the body portion moves further towards the trap housing, the flared portion is configured to bear against the flap and move the flap from the catch position to the opened position, and, with the flap in the opened position, the flap is clear of the release blade to permit the release blade to move to the release position.

16. The apparatus of claim 15, wherein a width of the flared portion at its widest point is greater than a width of the catch portion at its widest point.

17. The apparatus of claim 12, wherein the release blade is biased to the retained position.

18. The apparatus of claim 12, wherein the release blade is pulled manually from the retained position to the release position.

19. A counterweight rigging system, comprising:

a line set;

at least one counterweight arbor coupled to the line set;

at least one catch blade attached the counterweight arbor;

a trap housing attached to a support structure; and at least one flap mounted in the trap housing, the flap being moveable between a catch position in which the flap is engageable with the catch blade to prevent the counterweight arbor from moving away from the trap housing, and an opened position in which the catch blade is releasable from the trap housing to permit the counterweight arbor from moving away from the trap housing, wherein, when the catch blade is engaged with the flap, the trap housing is arranged to transfer load from the counterweight arbor to the support structure.

20. An arbor trap apparatus for use with at least one counterweight arbor, the apparatus comprising:

a trap housing for attachment to a support structure;

a catch blade comprising a body portion and a catch portion, the body portion for attachment to the counterweight arbor, the catch portion being generally symmetrical on generally opposing sides thereof and comprising on each of the opposing sides an angled flange and a barb arranged between the angled flange and the body portion; and first and second flaps mounted in the trap housing, the first and second flaps each moveable between a catch position in which the first and second flaps are engageable with the opposing sides of the catch blade and an opened position in which the catch blade is releasable from the trap housing, the first and second flaps biased towards one another to the catch position, wherein, as the body portion moves towards the trap housing, the angled flange bears against the flaps and at least partially moves the flaps from the catch position towards the open position until the angled flange has cleared through the flaps and the flaps return to the catch position, and wherein, as the body portion moves away from the trap housing, the barb engages edges of the flaps while in the catch position to prevent the body portion from moving away from the trap housing.

* * * * *